US006125475A

United States Patent [19]

Taylor

[11] Patent Number: 6,125,475

[45] Date of Patent: Oct. 3, 2000

[54] UTILITY SUSPENDERS

[76] Inventor: Lisa Ann Taylor, Rte. 1, Box 71-H, McDade, Tex. 78650

[21] Appl. No.: 09/332,861

[22] Filed: Jun. 15, 1999

[51] Int. Cl.[7] ..... A41F 19/00

[52] U.S. Cl. ..... 2/333; 2/326; 2/327; 182/3; 244/151 R

[58] Field of Search ..... 2/333, 94, 310, 2/326–328, 300, 230, 117, 247, 44–45, 267–268; D2/714, 624, 626, 640; 119/857; 182/3, 4; 244/151 R, 151 A

[56] References Cited

U.S. PATENT DOCUMENTS

| | | | |
|---|---|---|---|
| 305,606 | 9/1884 | Lawrence | 2/333 |
| D. 335,211 | 5/1993 | Hightower . | |
| 2,643,836 | 6/1953 | Carroll . | |
| 2,677,488 | 5/1954 | Prusan | 2/333 |
| 4,389,736 | 6/1983 | Clifton . | |
| 4,764,962 | 8/1988 | Ekman et al. | 381/24 |
| 4,853,979 | 8/1989 | Ryder . | |
| 4,949,888 | 8/1990 | May . | |
| 5,129,105 | 7/1992 | Kleinman | 2/328 |
| 5,177,814 | 1/1993 | Courtney | 2/326 |
| 5,319,806 | 6/1994 | Hermann et al. . | |
| 5,406,942 | 4/1995 | Loo | 128/100.1 |
| 5,623,735 | 4/1997 | Perry | 2/327 |
| 5,691,028 | 11/1997 | Curtis | 428/101 |
| 5,697,329 | 12/1997 | Bell et al. | 119/857 |
| 5,738,046 | 4/1998 | Williams et al. | 119/770 |
| 5,758,809 | 5/1954 | Bonner | 224/259 |
| 5,988,315 | 11/1999 | Crane | 182/3 |

FOREIGN PATENT DOCUMENTS

| | | |
|---|---|---|
| 260788 | 10/1928 | Italy . |

*Primary Examiner*—John J. Calvert
*Assistant Examiner*—Tejash Patel
*Attorney, Agent, or Firm*—Stephen R. Greiner

[57] ABSTRACT

Utility suspenders for use by individuals in the construction trades. The suspenders include a pair of padded and stretchable straps for suspension from the shoulders of a user. Clips, adapted to firmly grip a tool belt, are secured to the front and rear ends of the straps. A load-distributing pad secures the straps together adjacent their rear ends. A variable length, chest strap is slidably positioned on the straps adjacent their front ends and has a quick release buckle for splitting such in half.

3 Claims, 3 Drawing Sheets

UTILITY SUSPENDERS

FIELD OF THE INVENTION

The present invention relates generally to apparel and, more particularly, to garment supporters or retainers.

BACKGROUND OF THE INVENTION

Suspenders have long been used by construction workers to keep heavily laden, tool belts on their hips. These suspenders, unfortunately, have been inexpensively made with flimsy straps that tend to fall off the shoulders of wearers when they bend over requiring frequent adjustment. Worse, these straps also dig into the shoulders and spines of wearers. A need, therefore, exists for utility suspenders that can comfortably support a heavy load for lengthy periods of time and will remain firmly in place on the shoulders of a wearer throughout the period of use.

SUMMARY OF THE INVENTION

In light of the problems associated with the prior art, it is a principal object of the invention to provide suspenders which: are comfortable, are shock absorbing, and will not slide from the shoulders of a wearer.

It is an object of the invention to provide improved elements and arrangements thereof in suspenders for the purposes described which are lightweight in construction, inexpensive to manufacture, and dependable in use.

Briefly, the suspenders in accordance with this invention achieves the intended objects by featuring a pair of straps adapted to extend over the shoulders of a wearer. Clips, adapted to firmly grip a belt, are secured to the front and rear ends of the straps. A pad secures the straps together adjacent their rear ends. A chest strap is slidably positioned on the straps adjacent their front ends and has a quick release buckle for splitting such in half.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
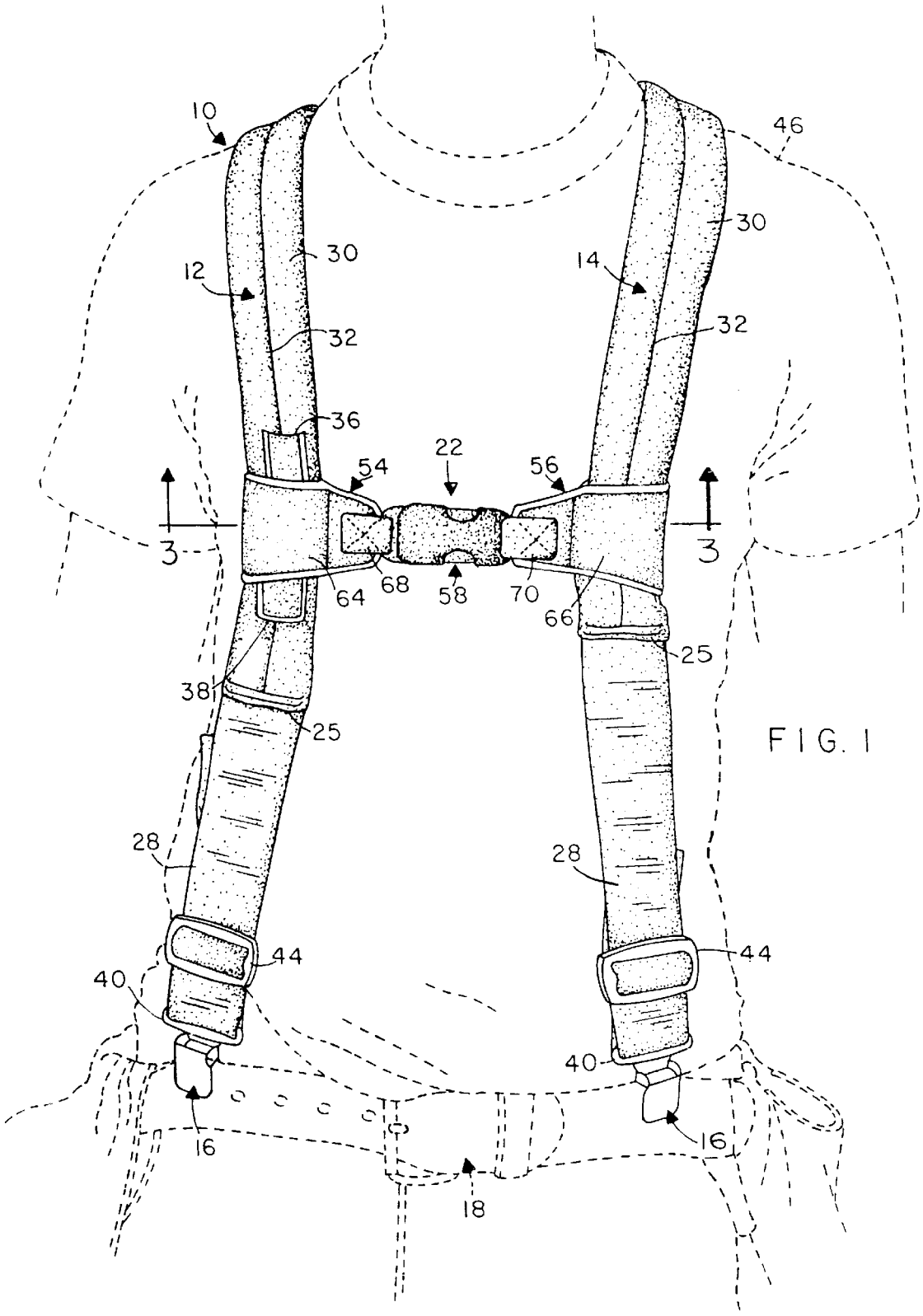
FIG. 1 is a front perspective view of utility suspenders in accordance with the present invention.
Figure 2:
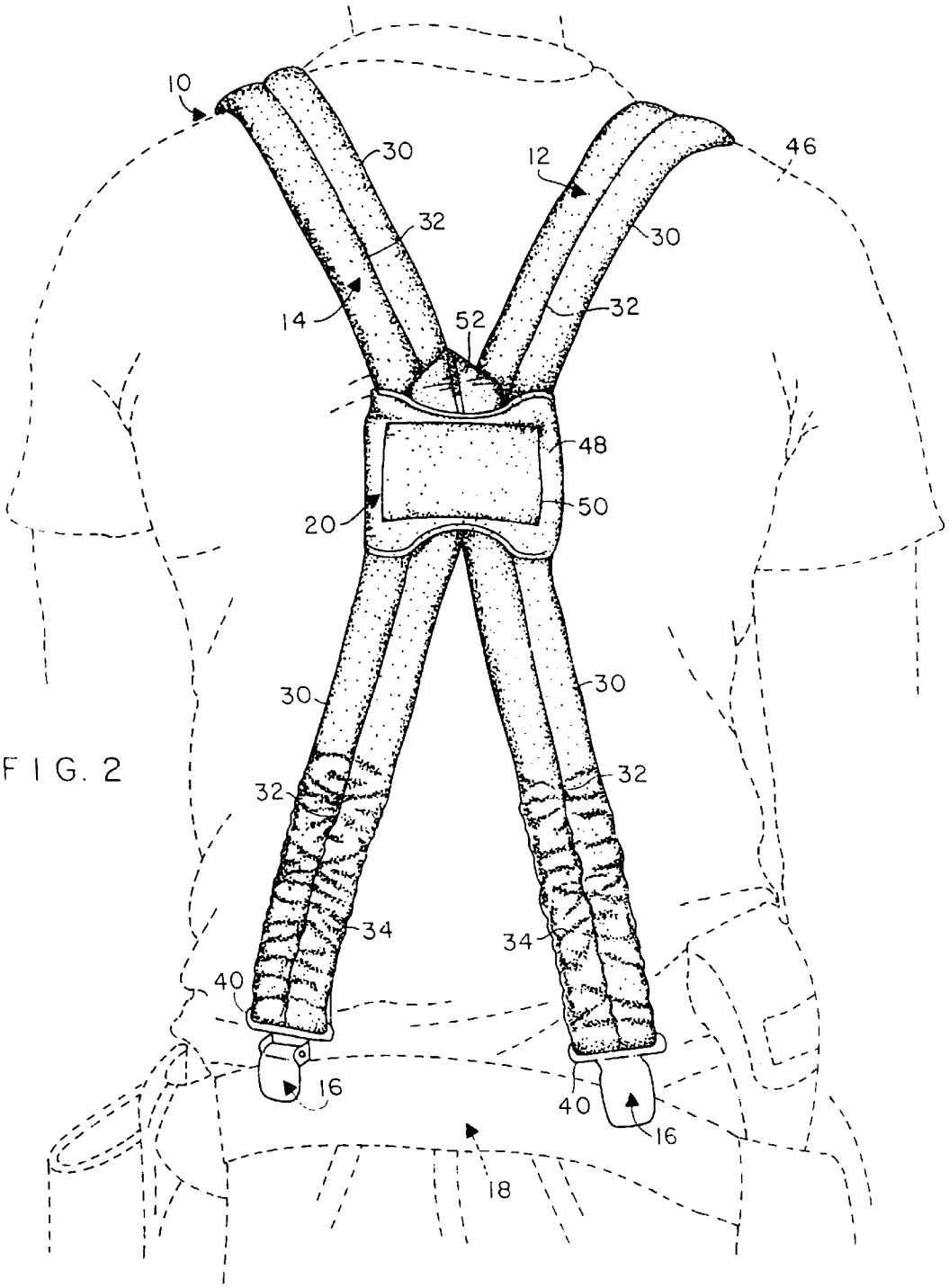
FIG. 2 is a rear perspective view of the utility suspenders of FIG. 1.
Figure 3:
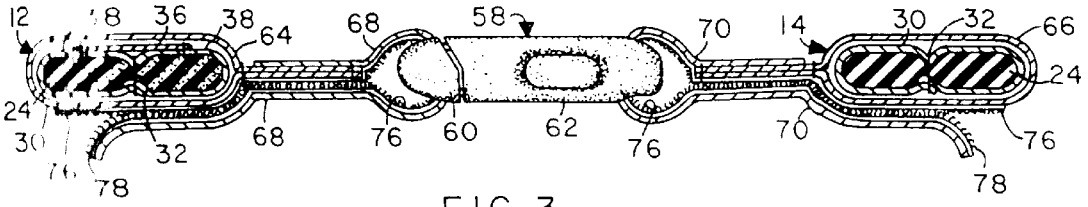
FIG. 3 is a cross-sectional view taken along line 3—3 of FIG. 1.
Figure 4:
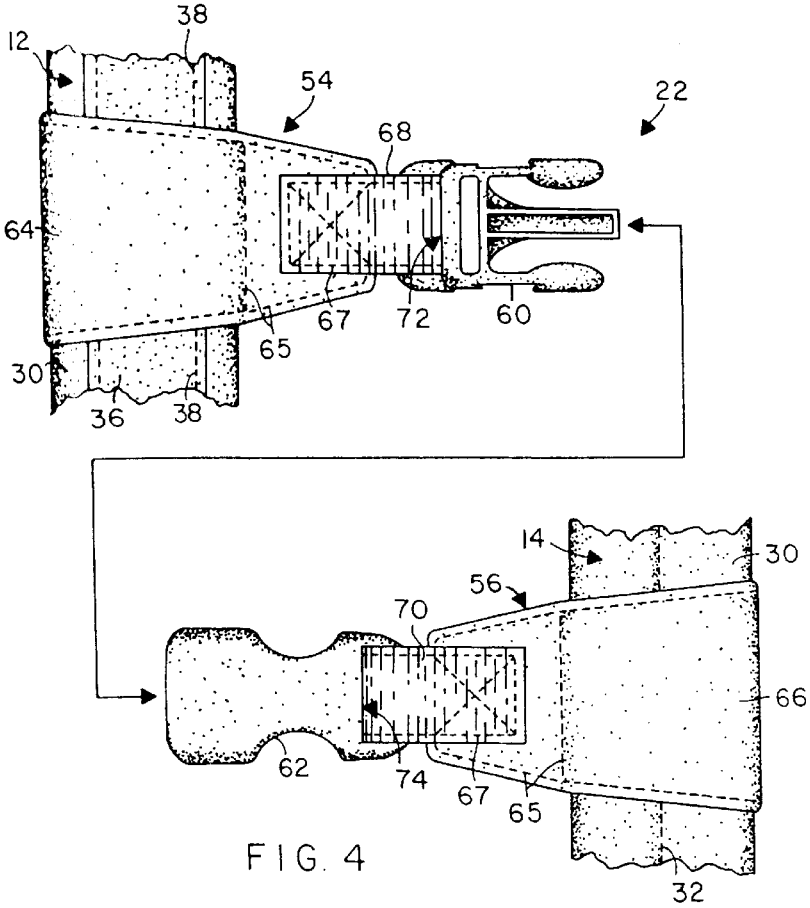
FIG. 4 is an enlarged, front view of the chest strap of the suspenders with the male and female components of its buckle being uncoupled.

Referring now to the FIGS., utility suspenders in accordance with the present invention are shown at 10. The suspenders 10 include a pair of shoulder straps 12 and 14 having clips 16 at their opposed ends for fastening to a tool belt 18. Between their ends, the straps 12 and 14 are joined together by both a load-distributing pad 20 and an adjustable, chest strap 22.

Each of the straps 12 and 14 includes a foam rubber member 24 having a strip of elastomeric material 26 secured to, and extending from, its rear end and a strip of heavy webbing 28 secured to, and extending from, its front end by sewn seams 25. The foam rubber member 24 and elastomeric strip 26 are encased in a fabric cover 30 for enhanced durability. A seam 32 sewn down the center of foam rubber member 24 and elastomeric strip 26 attaches the cover 30 thereto. Gathers 34 provided in the cover 30 adjacent the strip 26 permit such to lengthen and contract in response to loads placed on straps 12 and 14.

A rectangular, fabric panel 36 is attached along its bottom and side edges by a sewn seam 38 to the cover 30 of strap 12 adjacent webbing 28. The enclosed space between the panel 36 and cover 30 defines a pocket which may be used to retain a writing implement such as a pen (not shown).

Figure 5:
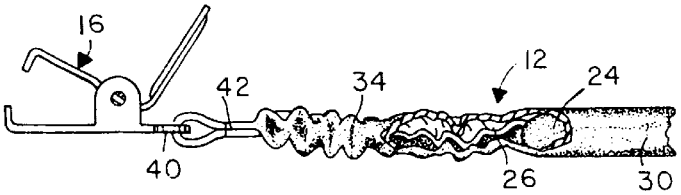
FIG. 5 is an enlarged, side view of the back end of the shoulder strap of the utility suspenders.
Figure 6:
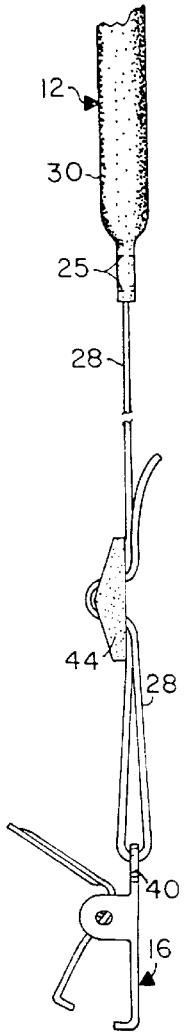
FIG. 6 is an enlarged, side view of the front end of the shoulder strap of the utility suspenders.

The clips 16 at the ends of straps 12 and 14 are equipped with retaining rings 40 at their upper ends. As shown in FIG. 5, the back ends of straps 12 and 14 are: inserted through the rings 40, folded back upon themselves, and attached together by a sewn seam 42 to join clips 16 to straps 12 and 14 adjacent the elastomeric strip 26. As shown in FIG. 6, however, the webbing 28 at the front ends of straps 12 and 14 is folded back upon itself but is retained in place by a catch 44 thereby permitting the length of straps 12 and 14 to be independently adjusted.

Pad 20 prevents straps 12 and 14 from sliding from shoulders 46 by attaching the straps together. The pad 20 is formed by wrapping a piece of doubled fabric 48 around the cover 30 of straps 12 and 14 and attaching such thereto by means of a sewn seam 50. The ends of a short strip of webbing 52 are secured by the seam 50 between the pad 20 and straps 12 and 14 so as to form a loop for hanging the suspenders 10 when not in use.

Chest strap 22 further prevents straps 12 and 14 from spreading apart and sliding from shoulders 46 during use. Chest strap 22 includes two segments 54 and 56 releasably joined by a quick release buckle 58 with male and female components 60 and 62. Segments 54 and 56 have fabric loops 64 and 66, closed by sewn seams 65, through which straps 12 and 14 slidably extend. Secured to loops 64 and 66 by sewn seams 67 are webbing strips 68 and 70 which reach through slots 72 and 74 in male and female components 60 and 62 of buckle 58. The strips 68 and 70 are provided with patches of loop-type fastening material 76 at their inner ends located adjacent loops 64 and 66 and patches of hook-type fastening material 78 at their outer ends. The patches 76 and 78 of each segment 54 and 56 may be selectively mated to vary the overall length of chest strap 22.

Use of suspenders 10 is straightforward. First, clips 16 are attached to tool belt 18 while straps 12 and 14 are draped over the shoulders 46 of a wearer. Next, the length of straps 12 and 14 is adjusted by means of catches 44. Then, the male and female components 60 and 62 of buckle 58 are joined to secure the front ends of straps 12 and 14 together with chest strap 22. If chest strap 22 is too long or too short, its length can be changed by refastening the hook and loop fastening patches 64 and 66. The process of donning the suspenders 10 requires only a few seconds but allows tool belt 18 to be comfortably carried for hours at a time.

While the invention has been described with a high degree of particularity, it will be appreciated by those skilled in the art that modifications may be made thereto. For example, the thickness of foam rubber members 24 can be varied along their lengths and, perhaps, increased at their centers where maximum pressure on shoulders 46 can normally be expected. Therefore, it is to be understood that the present invention is not limited to the sole embodiment described above, but encompasses any and all embodiments within the scope of the following claims.

I claim:

1. Suspenders, comprising:

a pair of shoulder straps adapted to extend over the shoulders of a wearer, each of said shoulder straps including:

a foam rubber member having opposed, front and rear ends;

a strip of webbing secured to said front end of said foam rubber member;

a strip of elastomeric material secured to, and extending from said rear end of said foam rubber member;

a fabric cover encasing said foam rubber member and said strip of elastomeric material, said fabric cover having a gathered portion adjacent said elastomeric material so as to permit the length of said strip of elastomeric material to stretch in response to loads placed thereon;

a first clip adjustably attached to said strip of webbing and adapted to firmly grip a belt; and, a second clip attached to said gathered portion of said fabric cover and adapted to firmly grip a belt;

a pad attached to said fabric cover adjacent said strip of elastomeric material of each of said straps for securing said straps together;

a chest strap having opposed ends slidably positioned on said shoulder straps adjacent said strips of webbing, said chest strap including two segments releasably attached by a quick release buckle, each of said segments including:

a fabric loop slidably positioned on a respective one of said shoulder straps;

a webbing strip extending from said fabric loop, said webbing strip having an inner end adjacent said fabric loop and an outer end remote from said fabric loop; and, hook and loop type fastening materials affixed to said inner and outer ends of said webbing strip for adjustable attachment of said webbing strip to said quick release buckle.

2. The suspenders according to claim 1 further comprising a fabric panel having bottom and side edges and being attached along said bottom and side edges to said fabric cover of one of said shoulder straps so as to form a pocket.

3. The suspenders according to claim 1 further comprising a loop secured between said pad and said shoulder straps for hanging said suspenders from a support.

* * * * *